US007987522B2

(12) United States Patent
Morgan et al.

(10) Patent No.: US 7,987,522 B2
(45) Date of Patent: Aug. 2, 2011

(54) SYSTEMS AND METHODS FOR PROVIDING MODULAR CAMOUFLAGE

(76) Inventors: Clyde S. Morgan, Mapleton, UT (US); Collin Morgan, Saratoga Springs, UT (US)

( * ) Notice: Subject to any disclaimer, the term of this patent is extended or adjusted under 35 U.S.C. 154(b) by 75 days.

(21) Appl. No.: 12/413,382

(22) Filed: Mar. 27, 2009

(65) Prior Publication Data

US 2009/0242597 A1 Oct. 1, 2009

Related U.S. Application Data

(60) Provisional application No. 61/040,080, filed on Mar. 27, 2008.

(51) Int. Cl.
*F41H 3/00* (2006.01)
*F41H 3/02* (2006.01)

(52) U.S. Cl. ..... 2/94; 2/100; 2/244; 2/265; 2/900

(58) Field of Classification Search ..... 2/94, 100, 2/97, 243.1, 244, 265, 272, 900
See application file for complete search history.

(56) References Cited

U.S. PATENT DOCUMENTS 1,139,642 A * 5/1915 Cox ..... 2/1
2,351,142 A * 6/1944 Meldon ..... 428/136
2,911,652 A * 11/1959 Ekman ..... 2/175.6
3,069,796 A * 12/1962 Benisch et al. ..... 428/17
4,106,124 A * 8/1978 Green ..... 2/422
4,375,488 A * 3/1983 Hogan ..... 428/17
4,495,239 A * 1/1985 Pusch et al. ..... 428/192
4,517,230 A * 5/1985 Crawford ..... 428/17
4,718,122 A * 1/1988 Steverson ..... 2/70
4,781,959 A * 11/1988 Gottlieb ..... 428/95
4,792,471 A * 12/1988 Lee ..... 428/17
5,010,589 A * 4/1991 Hamilton ..... 2/1
5,013,375 A * 5/1991 Leonard ..... 156/61
5,077,101 A * 12/1991 Conway et al. ..... 428/17
5,079,048 A * 1/1992 Anitole ..... 428/17
5,159,718 A * 11/1992 Moyer ..... 2/69
5,203,033 A * 4/1993 Sheppard et al. ..... 2/69
5,274,848 A * 1/1994 Shamblin ..... 2/69
5,281,460 A * 1/1994 Cox ..... 428/112
5,347,659 A * 9/1994 Tibljas ..... 2/84
5,445,863 A 8/1995 Slagle et al.
5,652,963 A * 8/1997 Davison ..... 2/206
5,675,838 A * 10/1997 Hollinger ..... 2/69
5,695,835 A 12/1997 Weber et al.
5,742,939 A * 4/1998 Williams ..... 2/69
5,742,985 A 4/1998 Larrabee
5,958,526 A 9/1999 Spickelmire (Continued)

FOREIGN PATENT DOCUMENTS

KR 20-1990-0005546 6/1990

*Primary Examiner* — Bobby H Muromoto, Jr.
(74) *Attorney, Agent, or Firm* — David B. Tingey; Kirton & McConkie

(57) ABSTRACT

Systems and methods for retaining camouflage material from the natural surrounding of a user. A device includes a retaining mechanism and at least two coupling mechanisms for attaching the device to the clothing, or person, of the user. Alternatively, the device includes elastomeric banding to attach a device to the user. The device includes a backing plate to provide tension across the retaining mechanism. The user immobilizes the camouflage material by inserting the camouflage material between the retaining mechanism and the clothing, apparel or person of the user.

20 Claims, 6 Drawing Sheets

U.S. PATENT DOCUMENTS 5,976,643 A * 11/1999 Sallee ..... 428/17
6,003,749 A * 12/1999 Sabo ..... 224/576
6,041,436 A * 3/2000 Keen ..... 2/69
6,060,142 A * 5/2000 Rossini ..... 428/52
6,127,007 A * 10/2000 Cox et al. ..... 428/15
6,199,212 B1 * 3/2001 Hambleton ..... 2/171
6,363,536 B1 * 4/2002 Sloan ..... 2/163
6,460,185 B1 * 10/2002 Hardy ..... 2/69
6,668,381 B2 * 12/2003 Tarrell ..... 2/69
6,712,058 B2 3/2004 Porter
6,735,781 B1 * 5/2004 Fulmer ..... 2/94
6,745,400 B1 * 6/2004 Paciorkowski ..... 2/69
6,851,126 B1 * 2/2005 Humphreys ..... 2/69
6,910,223 B2 6/2005 Egnew
7,036,154 B1 * 5/2006 McVay ..... 2/94
7,051,839 B1 * 5/2006 George ..... 182/116
7,143,452 B1 * 12/2006 Rossini ..... 2/209.13
7,650,899 B2 * 1/2010 Eastman et al. ..... 135/120.1
2003/0074825 A1 * 4/2003 Beaty ..... 43/1
2003/0200599 A1 10/2003 Shultz et al.
2003/0217406 A1 11/2003 Shultz et al.
2004/0231221 A1 * 11/2004 Latschaw ..... 43/1
2004/0237169 A1 * 12/2004 Wood et al. ..... 2/94
2004/0244095 A1 * 12/2004 Sonne et al. ..... 2/175.4
2005/0144760 A1 * 7/2005 Verbaas et al. ..... 24/3.1
2005/0198872 A1 * 9/2005 Correa ..... 36/136
2005/0218692 A1 * 10/2005 McNamee ..... 296/136.07
2005/0225126 A1 * 10/2005 Frederick ..... 297/4
2005/0275242 A1 * 12/2005 McNamee ..... 296/136.01
2006/0143771 A1 * 7/2006 Winkle et al. ..... 2/69
2007/0152007 A1 * 7/2007 Kauss et al. ..... 224/637
2007/0187444 A1 * 8/2007 Hajari ..... 224/155
2008/0032088 A1 * 2/2008 Callan ..... 428/102
2008/0034475 A1 * 2/2008 Boord ..... 2/209.13
2008/0066214 A1 * 3/2008 O'Hare ..... 2/172

* cited by examiner

SYSTEMS AND METHODS FOR PROVIDING MODULAR CAMOUFLAGE

RELATED APPLICATIONS

This application claims priority to U.S. Provisional Patent Application Ser. No. 61/040,080 filed Mar. 27, 2008, entitled "SYSTEMS AND METHODS FOR PROVIDING MODULAR CAMOUFLAGE."

BACKGROUND OF THE INVENTION

1. Field of the Invention

The present disclosure relates to modular camouflage outfit accessories and more particularly pertains to systems and methods for retaining camouflage material on a user's clothing, apparel and/or person.

2. Background and Related Art

Camouflage techniques are currently available for hunting. For example, camouflage clothing has been designed with different forms of patterns and colors for use in specific geographical areas. While such patterns have been available, none have been able to perfectly match every background environment. Thus, while a specific camouflage pattern material might function in general better than no camouflage pattern material at all, an alert animal can still quite easily visually detect a human outline.

Thus, while techniques currently exist that are used to provide camouflage, challenges still exist. Accordingly, it would be an improvement in the art to augment or even replace current techniques with other techniques.

SUMMARY OF THE INVENTION

The present disclosure relates to modular camouflage outfit accessories and more particularly pertains to systems and methods for retaining camouflage material on a user's clothing, apparel and/or person.

At least some implementations of the present invention take place in association with a modular camouflage system that includes plurality of individual retention devices. The retention devices are generally attached to the user's clothing, apparel, and/or person, by one or more coupling mechanisms. For example, in some implementations, the retention device is attached to the clothing of the user via a tack and clasp system, mating magnets, Velcro® and/or a system of straps and/or elastomeric banding.

In some implementations, the retention devices are positioned on the user's clothing, apparel, and/or person, as well as the user's equipment. The retention devices may also be positioned on an animal or vehicle of the user. The user may insert camouflage material into the retention device to further conceal the user and the user's equipment. The camouflage material may include both natural and artificial foliage as selected by the user. For example, the camouflage material may include natural foliage as selected by the user from the surroundings of the user, such as branches, twigs, grasses, leaves, and bracts.

The retention device further includes at least one retaining mechanism. The retaining mechanism generally includes an elastomeric band or strapping including a band of rubber or elastic fabric. In some implementations, the retention device includes coloring and markings to match the camouflage material of the system. The retaining mechanism is attached to the coupling mechanisms. As such, the user may attach the retaining mechanism to the user's clothing and person by attaching the coupling mechanisms to the clothing and person of the user. The coupling mechanisms are attached to the user's clothing and person such that a tension is formed across the retaining mechanism. As such, a user may outwardly bias the retaining mechanism of the retention device and provide a gap between the retaining mechanism and the clothing, or person, of the user. The user may then insert the camouflage material into the gap, thereafter releasing the outwardly biased retaining mechanism. The retaining mechanism then returns to an unbiased position whereby the tension of the retaining mechanism immobilized the camouflage material between the retaining mechanism and the clothing, apparel, or person, of the user.

Where the user desired to attach the retention device to a flimsy or structurally weak piece of clothing, the retention device may further comprise a backing plate. The backing plate includes a rigid or semi-rigid material that may provide a tension across the retaining mechanism of the device. The retaining mechanism is attached to the backing plate, in a tensioned state, and the backing plate is then attached to the user via one or more coupling mechanisms. As so configured, a user may immobilize camouflage material between the retaining mechanism and the backing plate. Alternatively, the backing plate may be positioned on the inner surface of the user's clothing and the retaining mechanism attached to the backing plate through the user's clothing. As such, the user may immobilize the camouflage material between the retaining mechanism and the user's clothing, while the backing plate provides a tension across the retaining mechanism.

The retention device may further comprise multiple retaining mechanisms. The retention device may also include a modified backing plate to accommodate the multiple retaining mechanisms. For example, the retaining device may include a backing plate with an upper and lower support for supporting an upper and lower retaining mechanism. The upper and lower supports may be coupled to one another via a linking support. The linking support may also support a third retaining mechanism. The multiple retaining mechanisms may be attached to the backing plate using any method previously described in connection with the other embodiments of the system.

In some implementations, the backing plate is modified to include a contoured surface. The contoured surface may be configured to compatibly engage the contours of the user's clothing and person. The contoured surface further increased the immobilization of the retention device by increasing the contact surface between the retention device and the contoured portion of the user's clothing or person.

While the methods and processes of the present invention have proven to be particularly useful in the area of hunting, those skilled in the art can appreciate that the methods and processes can be used in a variety of different applications for providing effective camouflage.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE INVENTION

The presently preferred embodiments of the present invention will be best understood by reference to the drawings, wherein like reference numbers indicate identical or functionally similar elements. It will be readily understood that the components of the present invention, as generally described and illustrated in the figures herein, could be arranged and designed in a wide variety of different configurations. Thus, the following more detailed description, as represented in the figures, is not intended to limit the scope of the invention as claimed, but is merely representative of presently preferred embodiments of the invention.

As provided herein, the present disclosure relates to modular camouflage outfit accessories and more particularly pertains to systems and methods for retaining camouflage material on a user's clothing, apparel and/or person.

Figure 1:
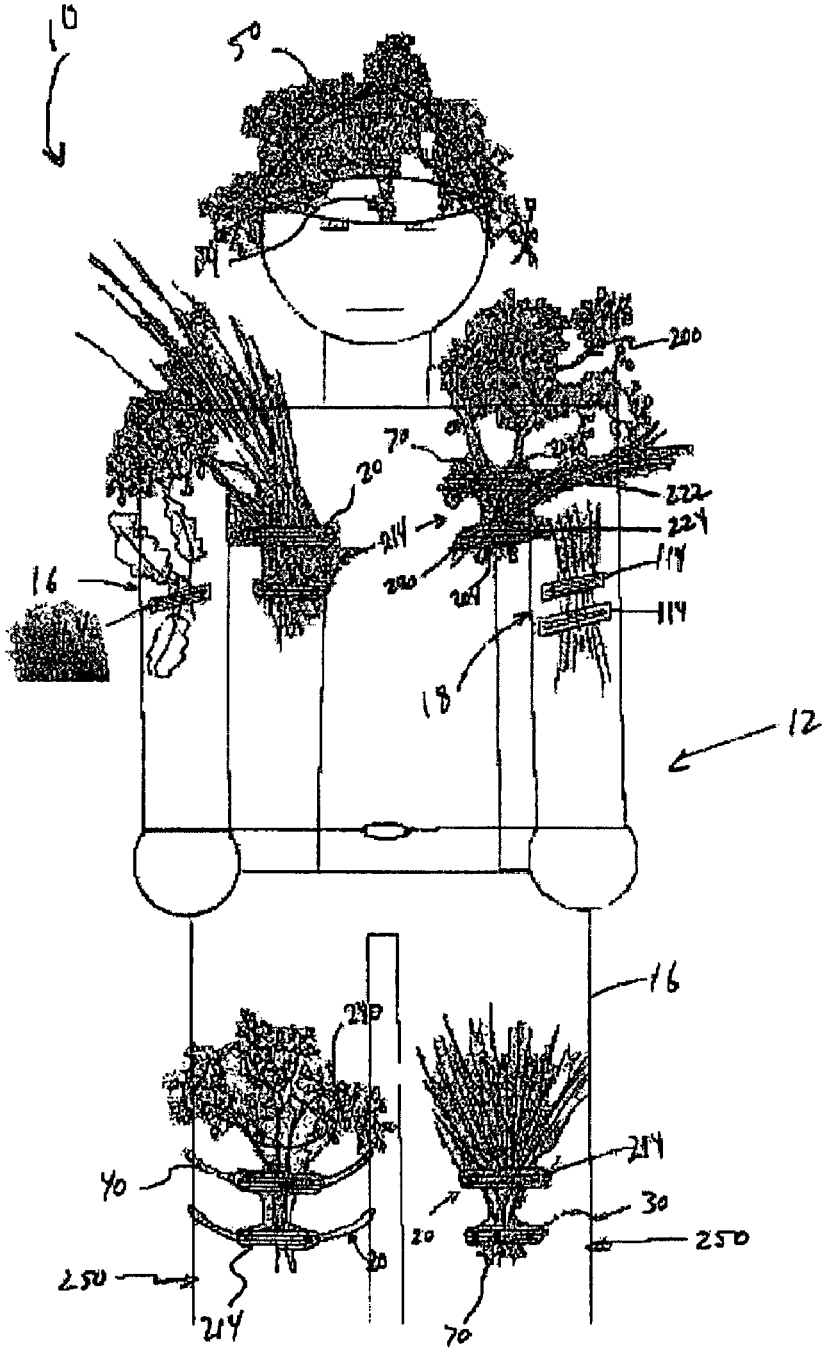
FIG. 1 is a front view of a representative embodiment of a modular camouflage system as displayed on a user.

Referring now to FIG. 1, a representative view of the modular camouflage system 10 is shown, as displayed on a user 12. The camouflage system 10 comprises a plurality of individual retention devices 14. The retention devices 14 are attached to the user's person and the user's clothing 16 by any number of coupling mechanism 20. For example, in one embodiment, the retention device 14 is attached to the clothing 16 of the user 12 via a tack and clasp system 22. In another embodiment, the retention device 14 is attached to the clothing 16 of the user 12 via mating magnets 30 or magnetic attraction. In another embodiment, the retention device 14 is attached to the user 12 via a pair of straps or a length of elastomeric banding. Such embodiments will be further discussed below.

A user 12 may position the retention devices 14 at strategic locations on the user's clothing 12 and person. A strategic location is understood as any position on the user's clothing 16 and person where the addition of camouflage material 60 may provide a benefit to the user 12. A strategic location is further understood as any position on the user's clothing 16 and person where the addition of camouflage material 60 breaks the natural lines or contours of the person. For example, the physical structure of the human body, clothing, and accessories, such as hunting and camping equipment, generally comprise rigid, linear profiles that are not commonly found in nature. The linear profiles create an outline of the respective object or person that does not adequately blend with the non-linear profiles of the surrounding terrain and foliage. The linear profiles, therefore, provide a visual indicator of the person's presence that is readily detectable by animals or other persons. In some embodiments of the present invention, a retention device 14 is positioned at a strategic location such that the provided camouflage material 60 masks the linear profile of the person or object. As such, the ability of the person or object to blend with the non-linear profiles of its surroundings is enhanced resulting in improved visual concealment.

The camouflage material 60 may include any natural or artificial foliage as selected by the user 12. For example, the camouflage material 60 may include a tree branch 200 as selected from the surroundings of the user 12. The camouflage material 60 may also include leaves, grasses, plants, shrubbery, and other natural foliage selected by the user 12. For example, in some embodiments the user selects camouflage material 60 from amongst the user's immediate surroundings. In other embodiments, the user selects camouflage material 60 from a first surrounding and then uses the selected camouflage material 60 in a second surrounding. The camouflage material 60 may also include artificial foliage selected to simulate the natural foliage of the user's 12 surroundings.

The user 12 may also position the retention devices 14 on articles other than the user's clothing 16 and person. For example, a user 12 may position a retention device 14 on the user's weapon or other accessories, such as a backpack or a pair of binoculars. A user 12 may also position a retention device 14 on an animal, such as a canine, where the addition of camouflage material 60 assists in concealing the animal.

Figure 2:
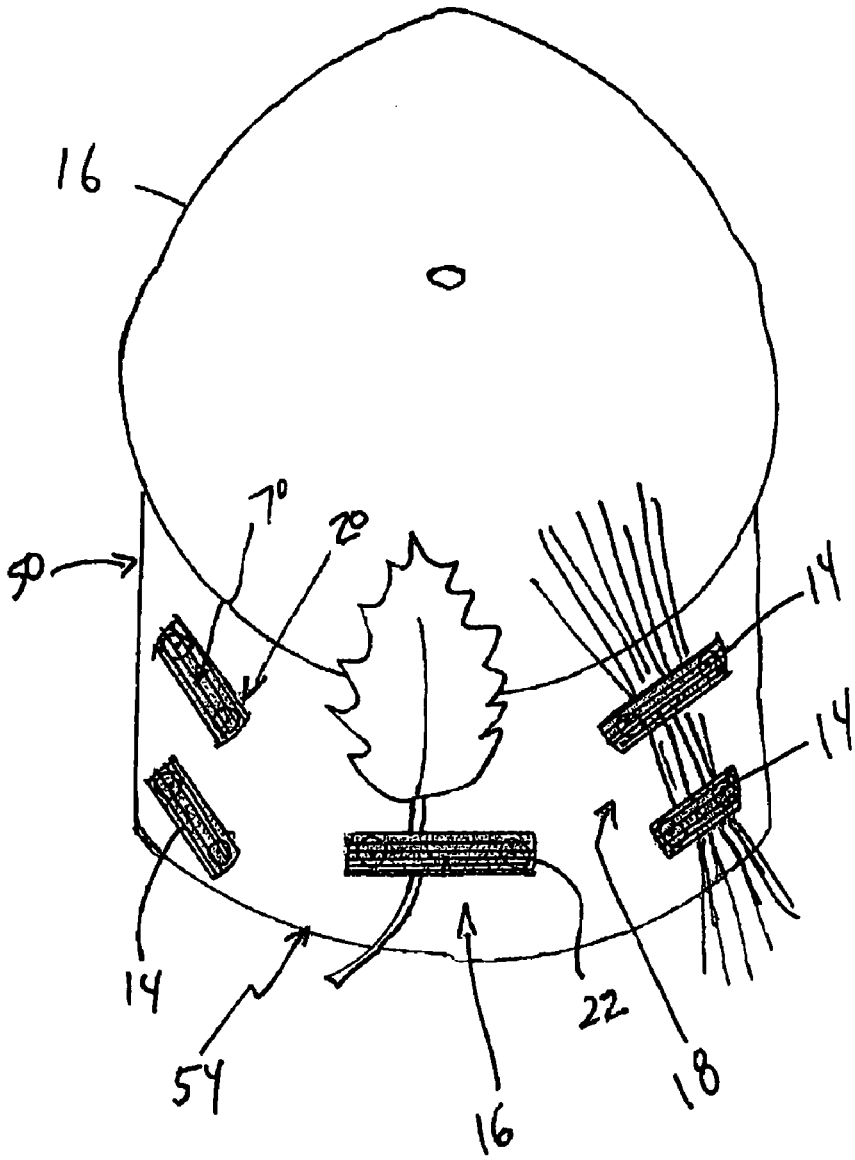
FIG. 2 is a is a top view of a representative embodiment of a modular camouflage system as displayed on apparel, such as a hat.
Figure 3:
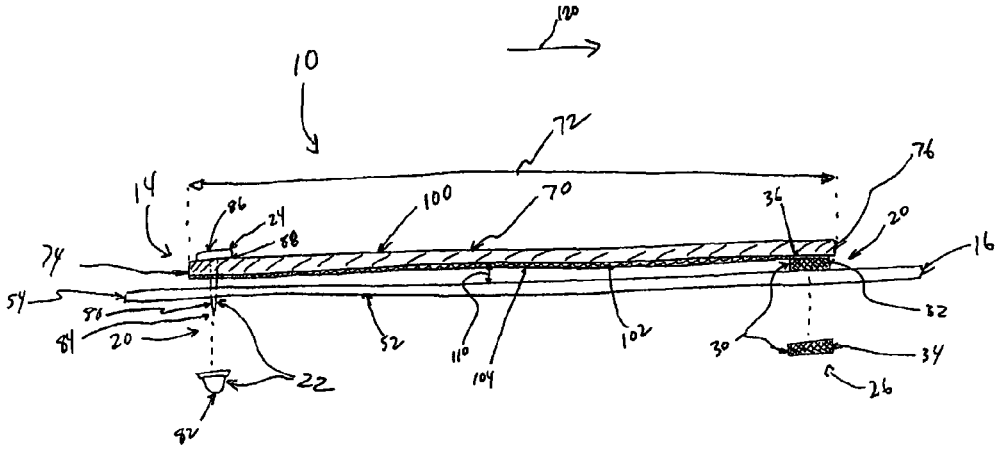
FIG. 3 is a side view of a representative component of a modular camouflage system.

Referring now to FIGS. 1-3, the retention device 14 generally comprises a coupling mechanism 20 and at least one retaining mechanism 70. As previously discussed, the coupling mechanism 20 may include a tack and clasp system 22, a mating magnets system 30, or a system of straps and/or elastomeric banding 40. Additional coupling mechanism 20 may include a Velcro® system, a button and hook system, a lacing system, and any other system appropriate to attach the retention device 14 to the user's clothing 16 and person. The retaining mechanism 70 may include an elastomeric band or strapping sufficient to retain desired camouflage material 60. The elastomeric band or strapping may include a band of rubber, or may include a fabric made of yarns containing an elastic material. The retaining mechanism 70 may also comprise designs and coloring to aid in concealing the retention device 14. For example, the retaining mechanism 70 may be colored and designed to match the desired camouflage material 60. The retaining mechanism 70 may further comprise any desired length 72. In one embodiment, the retaining mechanism 70 comprises a length 72 of about 3.2 mm. In another embodiment, the retaining mechanism 70 comprises a length 72 of about 130 mm, although any length may be successfully used within the scope of this invention.

At least one coupling mechanism 20 is needed to attach the retention device 14 to the clothing 16 or person of the user 12. In a preferred embodiment, at least two coupling mechanisms 20 are employed in attaching the retaining device 14 to the clothing 16, or person of the user 12. A first coupling mechanism 24 is positioned at a first end 74 of the retaining mechanism 70. As illustrated, where the coupling mechanism 20 is a tack and clasp system 22, the tack 80 of the first coupling mechanism 24 is driven through the material of the retaining mechanism 70 near the first end 74 of the retaining mechanism 70. The user 12 may desire to permanently couple the tack 80 to the retaining mechanism 70 by applying an adhesive or an epoxy to the mating surface 86 between the head 86 of the tack 80 and the outer surface 100 of the retaining mechanism 70.

Following placement of the tack 80 in the retaining mechanism 70, the tack 80 is further driven through the clothing 16 of the user 12 such that the tip 84 of the tack 80 extends beyond inner surface 52 of the clothing 16. The user 12 may then secure the first end 74 of the retaining mechanism 70 to the clothing 16 by capping the tip 84 of the tack 80 with the clasp 82. The clasp 82 is configured to retain the tack 80 via friction. The outer surface of the tack 80 and the inner surface of the clasp 82 may be modified to include complementary surfaces or textures so as to increase the force needed to separate the clasp 82 from the tack 80. The clasp 82 may further comprise a mechanism for releasing the tack 80 as needed. For example, the clasp 82 may include a button or surface by which the user 12 may depress to actuate the clasp 82 to release the tack 80.

A second coupling mechanism 26 is positioned at a second end 76 of the retaining mechanism 70. As illustrated, where the coupling mechanism 20 is a pair of mating magnets 30, a primary magnet 32 is first coupled to the second end 76 of the retaining mechanism 70. The primary magnet 32 may comprise any magnetic material of sufficient strength to immobilize the retention device 14 on the clothing 16 or person of the user 12. For example, the magnetic material may comprise rare earth elements, such as Neodymium. The primary magnet 32 may be permanently coupled to the retaining mechanism 70 by applying an adhesive or an epoxy to the interface 36 between the primary magnet 32 and the inner surface 102 of the retaining mechanism 70. Alternatively, the user 12 may position the primary magnet 32 on the outer surface 100 of the retaining mechanism 70. As such, a user may further minimize the gap 110 between the inner surface 102 of the retaining mechanism 70 and the clothing 16 of the user 12.

The second end 76 of the retaining mechanism 70 is affixed to the clothing 16 of the user 12 by placing a secondary magnet 34 on the inner surface 52 of the clothing 16 at a position opposite of the primary magnet 32. Prior to mating the two magnets 32, 34, the retaining mechanism 70 should be extended in a proximal direction 120 so as to place the retaining mechanism 70 under tension. As such, once the primary 32 and secondary 34 magnets are mated, the first and second coupling mechanisms 24, 26 immobilize the retaining mechanism 70 in a tensioned state. Once positioned, the gap 110 of the retention device 14 may be loaded with camouflage material 60 as desired by the user 12. This may be accomplished by outwardly biasing the retaining mechanism 70 so as to increase the size of the gap 110. Having enlarged the size of the gap 110, the user 12 may then insert camouflage material 60 into the gap 110.

The retaining mechanism 70 may further include a textured surface 104 comprising the inner surface of the retaining mechanism 70. The textured surface 104 may include a material to increase the friction coefficient of the inner surface 102 of the retaining mechanism 70. For example, the textured surface 104 material may include an abrasive material, an adhesive material, or a rubberized material. The material may also include a physical variation of the inner surface 102 of the retaining mechanism 70 so as to create a gripping surface with an increased friction coefficient.

The structural integrity of the clothing 16 will determine the amount of camouflage material 60 capable of being loaded into the retention device 14. For example, where the clothing 16 is thin or flimsy, the retaining mechanism 70 will not be able to be immobilized in a tensioned state. As such, when the user 12 attempts to insert camouflage material 60 into the gap 110, the retaining mechanism 70 will not have the required tension to hold the camouflage material 60 as desired. Instead, the retaining mechanism 70 will bias the thin material of the clothing 16 to a position where the retaining mechanism 70 is in a relaxed state. Conversely, where the clothing is rigid, such as the brim 54 of a cap 50 where the material has been stiffened by cardboard backing, the retaining mechanism 70 may be extended and immobilized in a tensioned state. As such, when the user 12 attempts to insert camouflage material 60 into the gap 110, the retaining mechanism 70 will be sufficiently tensioned so as to allow the user to insert and retain camouflage material 60 within the gap 110.

Figure 4:
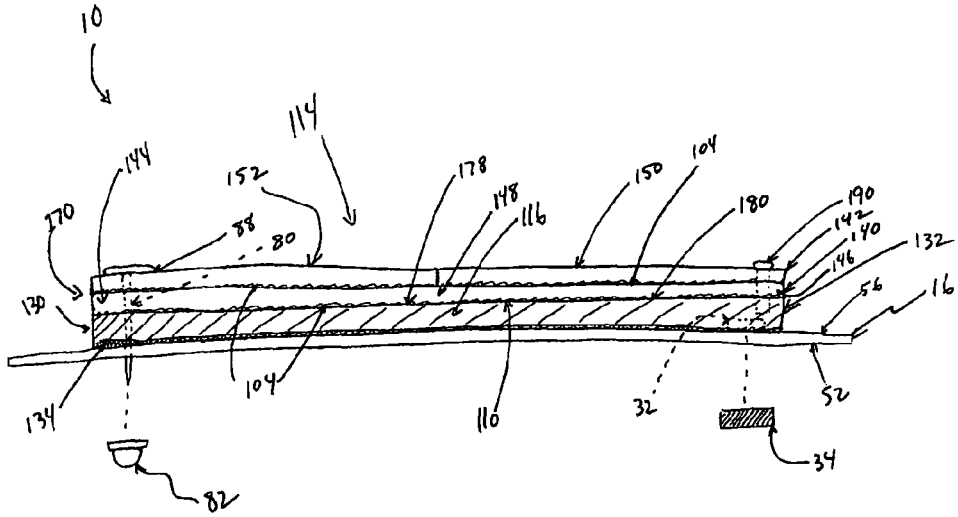
FIG. 4 is a side view of a representative component of a modular camouflage system.

Referring now to FIGS. 1 and 4, a user 12 may desire to position a retention device 14 at a location where the material of the clothing 16 is flimsy or otherwise lacking structural integrity sufficient to hold the retaining mechanism 70 in a tensioned state. Therefore, a retention device 114 is provided wherein the retention device 114 includes a rigid backing plate 116. The backing plate 116 is positioned between the outer surface 56 of the clothing 16 and the one or more retaining mechanisms 170. The backing plate 116 is generally rigid and comprises a material of sufficient structural integrity whereby the one or more retaining mechanisms 170 are immobilized on the backing plate 116 in a tensioned state. The backing plate 116 material may comprise a plastic, a metal, or a composite material.

The one or more retaining mechanisms 170 may be attached to the backing plate 116 by any known method. For example, the retaining mechanisms 170 may be coupled to the backing plate 116 via an adhesive or an epoxy, or mechanically with a tack 80, as illustrated. Alternatively, the retaining mechanism 170 may be coupled to the backing plate 116 via a rivet 190, a screw, a bolt and nut, via stitching, or another mechanical method of attachment, such as by Velcro®.

A first and second end 174, 176 of the retaining mechanism 170 is affixed to a first and second end 130, 132 of the backing plate 116, respectively. The first and second ends 174, 176 of the retaining mechanism 170 are affixed to the backing plate 116 such that a middle portion 178 of the retaining mechanism 170 is not attached to the backing plate 116. As such, the user 12 may outwardly bias the retaining mechanism 170 of the retention device 114 to provide a gap 110 at the interface 180 between the retaining mechanism 170 and the backing plate 116. In this manner, a user 12 may immobilize camouflage material 60 within the gap 110, similar to the method described in connection with FIG. 3 above.

The retention device 114 may be attached to the clothing 16 of the user 12 by any of the previously discussed methods. Additionally, where the backing plate 116 comprises a metal material, such as steel, the user 12 may immobilize the retention device 114 on the clothing 16 of the user via a magnet 34. This may be accomplished by mating the magnet 34 to the metal material of the backing plate 116 with the magnet 34 on the inner surface 52 of the clothing 16. Alternatively, a primary magnet 32 may be embedded within a portion of the backing member 116, where the backing plate 116 comprises a material incompatible with magnets, or where additional immobilization of the retention device 114 is desired. An inner surface 134 of the backing plate 116 may be modified to include a texture or gripping surface to further immobilize the retention device 114 on the clothing 16 of the user 12.

The one or more retaining mechanisms 170 may include a plurality of individual retaining mechanisms. For example, the retention device 114 comprises a primary 140 and a secondary 142 retaining mechanism. The primary retaining mechanism 140 is attached to the first and second ends 130, 132 of the backing plate 116 as previously described. The secondary retaining mechanism 142 is attached to the primary retaining mechanism 140 at a first end 144, at a second end 146 and a middle portion 148 of the primary retaining mechanism 140. As such, the secondary retaining mechanism 142 is divided into a proximal half 150 and a distal half 152. Therefore, the user 12 may deposit and retain camouflage material 60 either in the gap 110 between the primary retaining mechanism 140 and the backing plate 116, or between either of the proximal 150 and distal 152 halves of the secondary retaining mechanism 142 and the outer surface 160 of the primary retaining mechanism 140. By providing multiple retaining mechanisms 170, the retention device 114 may accommodate a wider variety, and greater amount, of camouflage material 60.

Figure 5:
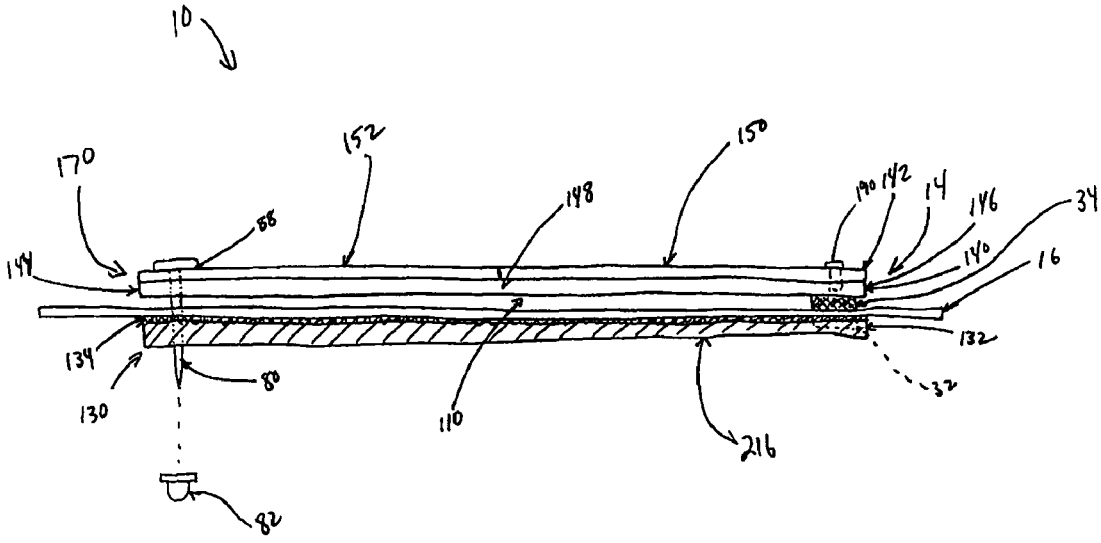
FIG. 5 is a side view of a representative component of a modular camouflage system.

Referring now to FIG. 5 another embodiment of the retention device 14 is shown. The retention device 14 may also be combined with an internal backing plate 216. As such, a user 12 may position the retention device 14 on a piece of clothing 16 that is flimsy or otherwise lacking the requisite structural integrity, as previously discussed. The internal backing plate 216 differs from the previously disclosed backing plate 116 in that the internal backing plate 216 is not directly affixed to the one or more retaining mechanisms 170. Rather, the primary and secondary retaining mechanisms 140, 142 are coupled to one another independent of the backing plate 216. For example, the secondary retaining mechanism 142 may be fixed directly to the first end 144, the second end 146 and the middle portion 148 of the primary retaining mechanism 140, as previously discussed in connection with FIG. 4. Alternatively, the first and second ends 144, 146 of the primary retaining mechanism 140 may be indirectly attached to the secondary retaining mechanism 142 via a mechanical connector, such as a tack 80, a rivet 190, or other methods of attachment previously discussed. As configured, the user 12 may insert and retain camouflage material 60 between the primary retaining mechanism 140 and the clothing 16, as well as between the proximal and distal halves 150, 152 of the secondary retaining mechanism 142 and the primary retaining mechanism 140, as previously described.

Referring again to FIGS. 1 and 5, the user 12 may position any number of retention devices 14 so as to provide sufficient concealment to the user's person. For example, a user 12 may position multiple retention devices 14 on the user's cap or hat 50 to provide sufficient coverage to the user's head and face. The retention devices 14 may be used individually 16 or in tandem 18. For example, when used individually 16, the retention device 14 bears the entire burden of retaining the camouflage material 60. As such, the camouflage material 60 is retained at only one point and may therefore rotate about the axis of the retention point. While this may be acceptable for lightweight camouflage material 60, such as leaves and grasses, this may not be acceptable for heavier camouflage material 60. Where the camouflage material 60 includes heavier branches and plants the user 12 may prefer to restrict the rotation of the camouflage material 60. This may be accomplished either by using individual retention devices 14 in tandem 18 or by using a retention device that incorporates multiple points of retention.

Figure 6:
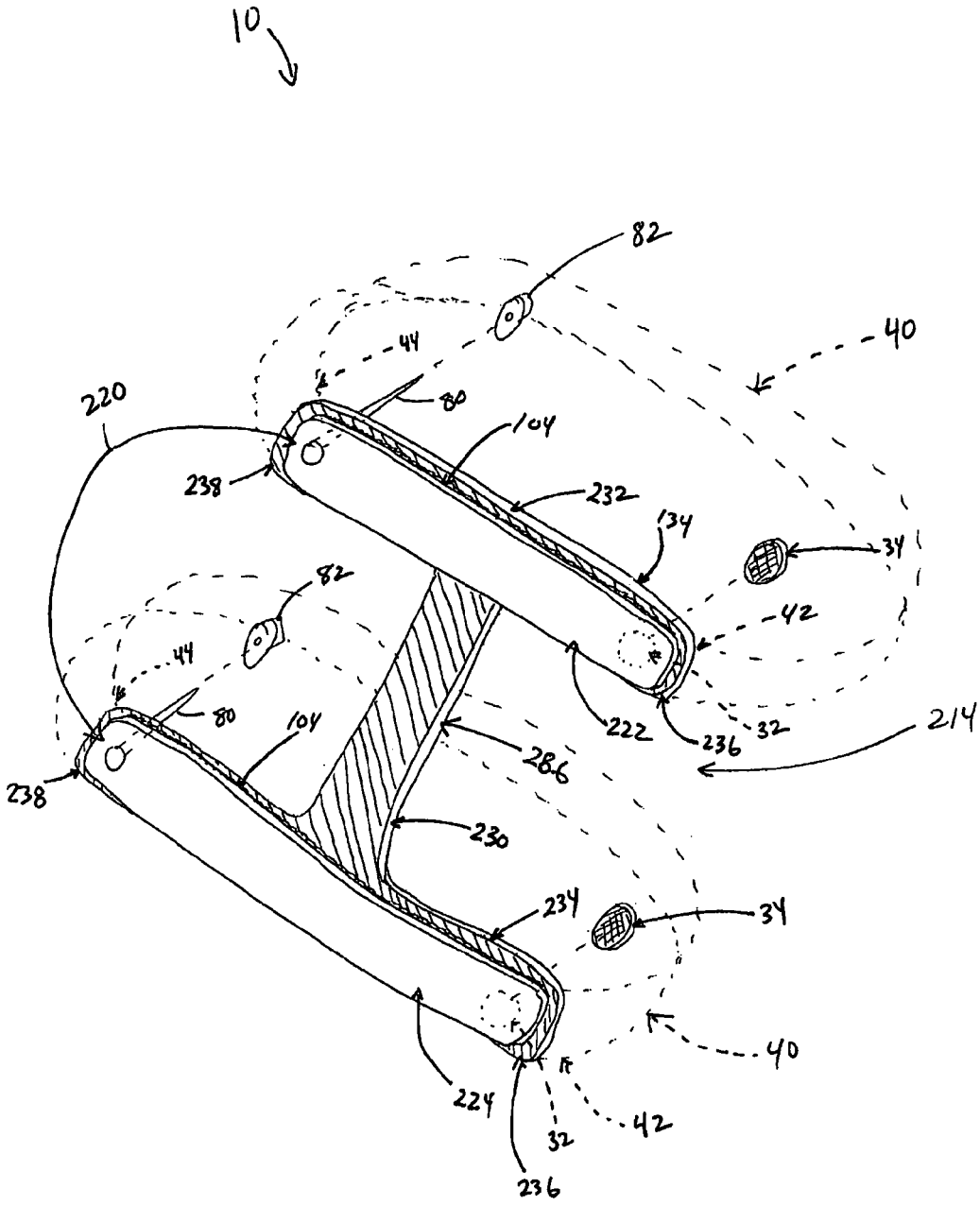
FIG. 6 is a perspective view of a representative component of a modular camouflage system.

Referring now to FIGS. 1 and 6, a third component 214 of the camouflage system is shown. The retention device 214 comprises multiple points of retention, or multiple, independent retaining mechanisms 220. In one embodiment the retention device 214 comprises an upper retaining mechanism 222 and a lower retaining mechanism 224. As such, the user 12 may position desired camouflage material 60 in the upper and lower retaining mechanisms 222, 224 to prevent undesirable rotation of the camouflage material 60. For example, where the camouflage material 60 is a tree branch 200, the user 12 may retain a first portion 202 of the tree branch 200 with the upper 222 retaining mechanism and retain a second portion 204 of the tree branch 200 with the lower 224 retaining mechanism. By retaining the tree branch 200 at multiple retention points 202, 204, the tree branch 200 is prevented from rotating relative to the retaining mechanism 214.

The retaining mechanism 214 further includes a backing plate 230. The backing plate 230 comprises a rigid material with properties similar to those of the previous backing plate 116. However, unlike the previous backing plate 116, the current backing plate 230 comprises an upper backing support 232 and a lower backing support 234. Additionally, the backing plate 230 includes a linking support 286 for coupling the upper backing support 232 to the lower backing support 234. In a preferred embodiment, the linking support 286 comprises the same material as the upper and lower backing supports 232, 234, however various materials may be combined to provide the backing plate 230 of the current device. The backing plate 230 may also include a textured surface 134 to further immobilize the retaining mechanism 214 on the clothing 16 or person of the user 12, as similarly incorporated in other embodiments of the camouflage system 10.

The upper and lower backing supports 232, 234 support the upper and lower retaining mechanisms 222, 224, respectively. The upper and lower retaining mechanisms 222, 224 are secured to the upper and lower backing supports 232, 234 by any method previously discussed in connection with the other embodiments of the invention. Additionally, the upper and lower retaining mechanisms 222, 224 may include additional or secondary retaining mechanisms 142, as described in the previous embodiments.

The retention device 214 may be attached to the clothing 16 or person of the user 12 by any previously discussed method, including attachment via a system of straps or elastomeric banding 40. A first end 42 of the banding 40 may be attached to a proximal end 236 of the upper and lower 232, 234 backing supports. The first end 42 may be permanently attached via a mechanical fastener, or may be reversibly attached via a clasping or buckling system. Alternatively, the first end 42 may be reversibly attached via a Velcro® system. The second end 44 of the banding 40 may be attached to a distal end 238 of the upper and lower 232, 234 backing supports. The second end 42 may also be permanently or reversibly attached to the backing support 214, as described above. The banding 40 may further comprise features for adjusting the length and tension of the banding 40 to provide an adjustable fit for the user 12. Finally, the banding 40 may include coloring and patterns to simulate the camouflage material 60 of the system 10.

Figure 7:
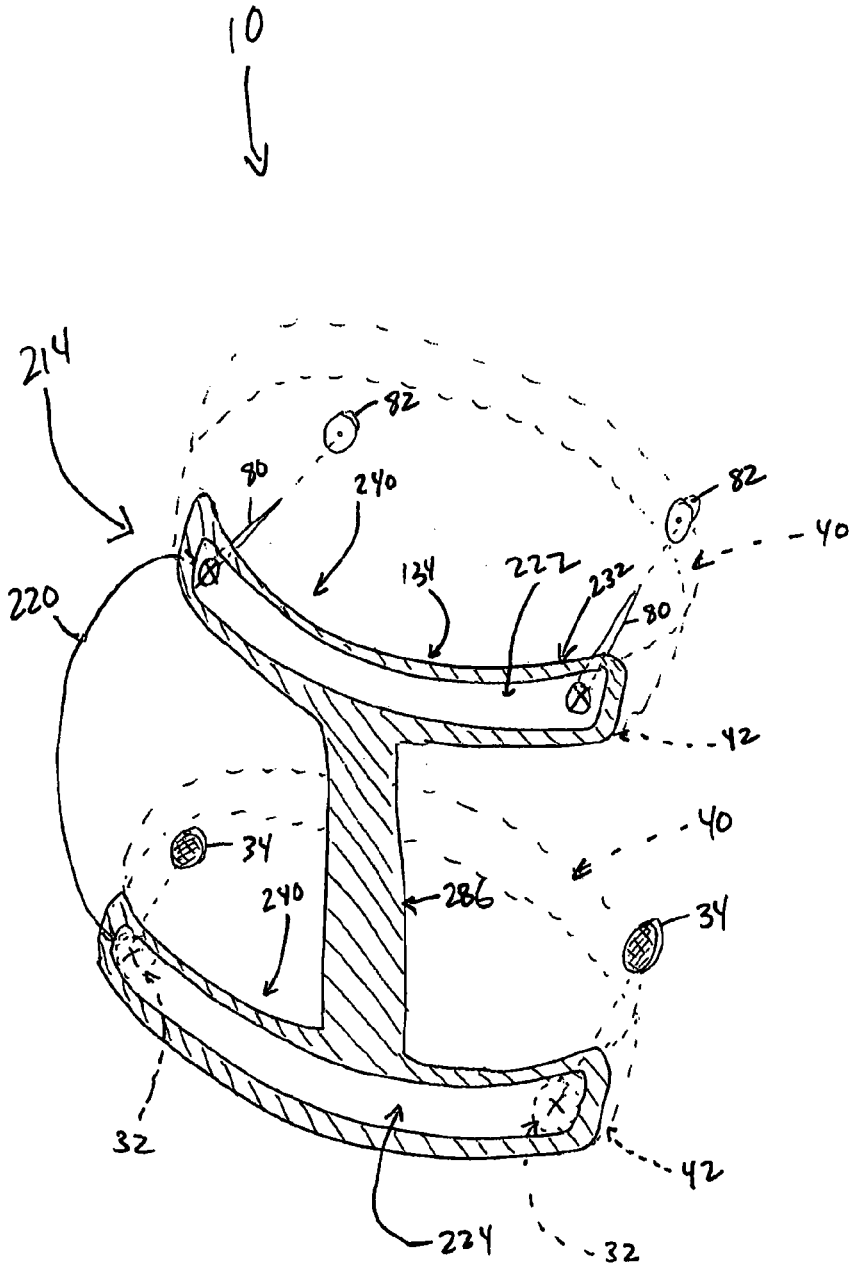
FIG. 7 is a perspective view of a representative component of a modular camouflage system having a contoured surface.

Referring now to FIG. 7, the upper and lower backing supports 232, 234 of the retention device 214 may be further modified to include a contoured surface 240. The contoured surfaces 240 may be configured so as to ergonomically fit a curved surface of the user's clothing 16 or person. For example, the contoured surface 240 may be configured to ergonomically fit the contours of the user's leg or shin 250. As such, the retention device 214 may compatibly interface with the user's contours as well as increase the contact surface with the user's clothing 16 and person.

Thus, as discussed herein, the embodiments of the present invention embrace modular camouflage. In particular, at least some embodiments of the present invention relate to systems and methods for retaining camouflage material on a user's clothing, apparel and/or person.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A device for retaining a camouflage material, the device comprising:

an elastomeric retaining mechanism having a first end and a second end;

a first coupling mechanism attached to the first end of the elastomeric retaining mechanism and to a rigid surface;

a second coupling mechanism attached to the second end of the elastomeric retaining mechanism and to the rigid surface; and a receiving gap selectively formed between the elastomeric retaining mechanism and the rigid surface to receive and retain the camouflage material, wherein the receiving gap is formed upon moving the elastomeric retaining mechanism away from the rigid surface.

2. The device of claim 1, wherein the elastomeric retaining mechanism comprises a piece of elastomeric banding.

3. The device of claim 1, wherein the elastomeric coupling mechanism is at least one of a tack and clasp system, a pair of mating magnets, a length of elastomeric banding, a strap, and a hook and loop system.

4. The device of claim 1, wherein the rigid surface is at least one of a piece of clothing, a hat, a portion of a user's body, an animal, an item of hunting equipment, an item of camping equipment, and a vehicle.

5. The device of claim 1, wherein the camouflage material is selected from a natural surroundings of a user.

6. The device of claim 1, wherein the camouflage material is artificial.

7. The device of claim 1, further comprising a backing plate interposed between the elastomeric retaining mechanism and the rigid surface.

8. The device of claim 1, further comprising a backing plate maintaining a tension across the elastomeric retaining mechanism, wherein the rigid surface is interposed between the backing plate and the elastomeric retaining mechanism.

9. The device of claim 1, wherein the receiving gap comprises a plurality of receiving gaps.

10. The device of claim 1, further comprising a plurality of stacked elastomeric retaining mechanisms, wherein a receiving gap is interposed between adjacent stacked elastomeric retaining mechanisms.

11. A method for manufacturing a camouflage retaining device, the method comprising:

providing elastomeric retaining mechanism having a first end and a second end;

attaching a first coupling mechanism to the first end of the elastomeric retaining mechanism and to a rigid surface;

attaching a second coupling mechanism to the second end of the elastomeric retaining mechanism and to the rigid surface; and selectively forming a receiving gap formed between the elastomeric retaining mechanism and the rigid surface to receive and retain a camouflage material, wherein the receiving gap is formed upon moving the elastomeric retaining mechanism away from the rigid surface.

12. The method of claim 11, wherein the elastomeric retaining mechanism comprises a piece of elastomeric banding.

13. The method of claim 11, wherein the elastomeric coupling mechanism is at least one of a tack and clasp system, a pair of mating magnets, an elastomeric loop, a strap, and a hook and loop system.

14. The method of claim 11, wherein the rigid surface is at least one of a piece of clothing, a hat, a portion of a user's body, an animal, an item of hunting equipment, an item of camping equipment, and a vehicle.

15. The method of claim 11, further comprising providing a backing plate interposed between the elastomeric retaining mechanism and the rigid surface, wherein the first and second ends of the retaining mechanism are further coupled to the backing plate.

16. The method of claim 11, wherein the receiving gap comprises a plurality of receiving gaps.

17. The method of claim 11, further comprising the step of providing a plurality of stacked elastomeric retaining mechanism, wherein a receiving gap is interposed between adjacent, stacked elastomeric retaining mechanisms.

18. A camouflage retaining system, comprising:

a backing plate having a front surface and a back surface, the front surface being configured to support a camouflage material, and the back surface being configured to interface with a rigid surface;

an elastomeric retaining mechanism coupled to the front surface of the backing plate;

a coupling mechanism attached to the backing plate and securing the backing plate to the rigid surface; and a receiving gap selectively formed between the retaining mechanism and the front surface of the backing plate to receive and retain a camouflage material, wherein the receiving gap is formed upon moving the elastomeric retaining mechanism away from the front surface of the backing plate.

19. The system of claim 18, wherein the back surface of the backing plate further comprises a textured surface to increase a friction coefficient between the backing plate and the rigid surface.

20. The system of claim 18, wherein the front surface of the backing plate further comprises a first mounting surface and a second mounting surface, the first mounting surface having a first elastomeric retaining mechanism, and the second mounting surface having a second elastomeric retaining mechanism, a first receiving gap being interposed between the first mounting surface and the first elastomeric retaining mechanism, and a second receiving gap being interposed between the second mounting surface and the second elastomeric retaining mechanism, wherein the camouflage material is retained in a desired position via the first and second retaining gaps of the first and second mounting surfaces and first and second elastomeric retaining mechanisms.

* * * * *